US006729465B2

(12) United States Patent
Bernhardt et al.

(10) Patent No.: US 6,729,465 B2
(45) Date of Patent: May 4, 2004

(54) PLANT AND A METHOD FOR TRANSPORTING TEXTILE FABRICS

(75) Inventors: Siegfried Bernhardt, Bremen (DE); Robert Kamprath, Brake (DE); Heinz-Werner Naumann-Burghardt, Berne (DE)

(73) Assignee: Spinnbau GmbH, Bremen (DE)

( * ) Notice: Subject to any disclaimer, the term of this patent is extended or adjusted under 35 U.S.C. 154(b) by 0 days.

(21) Appl. No.: 10/253,876

(22) Filed: Sep. 25, 2002

(65) Prior Publication Data

US 2003/0057057 A1 Mar. 27, 2003

(30) Foreign Application Priority Data

Sep. 25, 2001 (DE) ..... 01 122 930

(51) Int. Cl.[7] ..... B65G 13/02

(52) U.S. Cl. ..... 198/689.1; 198/689.1; 19/296

(58) Field of Search ..... 198/689.1; 19/296

(56) References Cited

U.S. PATENT DOCUMENTS 3,862,472 A * 1/1975 Norton et al. ..... 19/145.5
3,898,788 A * 8/1975 Fehrer ..... 57/401
4,130,915 A * 12/1978 Gotchel et al. ..... 19/304
4,904,439 A * 2/1990 Farrington et al. ..... 264/510
5,093,962 A * 3/1992 Farrington et al. ..... 19/296

FOREIGN PATENT DOCUMENTS

EP 0 817 875 B1 7/2000

* cited by examiner

*Primary Examiner*—Christopher P. Ellis
*Assistant Examiner*—Richard Ridley
(74) *Attorney, Agent, or Firm*—Diller, Ramik & Wight

(57) ABSTRACT

In the case of a plant for transporting textile fabrics (1), with at least one permeable and suctioned conveyor belt (4) for the transport of a textile fabric (1) delivered by a textile machine onto the conveyor belt (4) at a delivery point (5), it is provided that on the side of the conveyor belt (4) facing away from the textile fabric (1), several air guiding means (6) extending transversely to the conveyor belt (4) are arranged, said air guiding means deflecting the air entrained by the conveyor belt (4) on the side facing away from the textile fabric (1).

29 Claims, 5 Drawing Sheets

PLANT AND A METHOD FOR TRANSPORTING TEXTILE FABRICS

BACKGROUND OF THE INVENTION

The invention relates to a plant as well as a method for transporting textile fabrics, as well as to a plant and a method for manufacturing nonwoven mats.

Such plants are known from the European Patent EP 0 817 875 A, for example. In the known plant, at least one nonwoven mat is mechanically delivered onto a permeable and suctioned conveyor belt particularly suctioned at the point of delivery by means of a suction box. A disadvantage thereof is that for suctioning the conveyor belt, several suction means arranged over the length of the conveyor belt are required, the suction intensities of which have to be coordinated and which lead to high energy consumption.

OBJECT OF THE INVENTION

It is the object of the present invention to provide a plant and a method for transporting textile fabrics and for manufacturing nonwoven mats, respectively, which permit the transport of textile fabrics even at high transport speeds without permanent under suction by suction means.

This object is solved according to the present invention. The invention advantageously provides that several air guiding means extending transversely to the conveyor belt are arranged on the side of the conveyor belt facing away from the textile fabrics, said air guiding means deflecting the air entrained by the conveyor belt on the side facing away from the textile fabrics. The invention advantageously permits the transport of textile fabrics at a high transport speed of more than 100 m/min without a permanent suctioning of the conveyor belts by the use of suction means at their lower surface. The suction airflow required for the transport at high transport speeds is achieved by solely deflecting the air entrained on the lower surface of the conveyor belt. This results in a proportional connection between the conveyor belt speed and the adhesion of the textile fabric on the conveyor belt. Since the plant does not need any suction means, the requirement of regulating the suction means is eliminated. Moreover, the power consumption of the suction means is eliminated so that not only the costs of the plant but also the operational costs can be reduced.

The edge of the air guiding means facing the conveyor belt extends at a short, preferably adjustable, distance to the conveyor belt. The short distance of the air guiding means to the conveyor belt guarantees that the far prevalent portion of the air entrained on the lower surface of the conveyor belt is able to be deflected to achieve the desired airflow through the textile fabric and the conveyor belt. Due to the fact that the distance is adjustable, it is possible to adjust the suction power. Preferably, however, a distance between 0.1 and 10 mm is set.

Preferably, the air guiding means are stationarily mounted on a supporting structure extending at a distance from the conveyor belt or, alternatively, mounted so as to be displaced parallel to and in longitudinal direction of the conveyor belt. The parallel displacement of the air guiding means in longitudinal direction of the conveyor belt also permits an individual adaptation of the airflow to specific requirements in certain route sections of the conveyor belt. Preferably, the air guiding means are equally spaced from each other in transport direction.

In a preferred embodiment, the air guiding means are adapted to be pivoted about an axis extending parallel to the conveyor belt and transversely to the transport direction. Thus, the distance of the air guiding means to the conveyor belt is adjustable in a simple and quick manner.

In one embodiment, it is provided that the air guiding means are arranged only in the border portion of the conveyor belt. In this case, the textile fabric is retained on the conveyor belt by its suctioned border portions in particular.

According to another embodiment, it may be provided that air guiding means are provided over the entire working width of the conveyor belt or only in the border portion in alternating arrangement. It is possible to arrange several air guiding means of the same type behind one another.

The air guiding means may extend at an angle of approximately 5 to 90° relative to the plane of movement of the conveyor belt.

According to a preferred embodiment, the air guiding means have an aerodynamic wing profile in cross section. The aerodynamic wing shape supports the deflection of the air entrained by the conveyor belt and thereby increases the suction power and thus the adhesion of the textile fabric on the conveyor belt.

According to another embodiment, it is provided that the air guiding means extending over the entire working width extend, in top view, in the shape of an arrow, and the tip of the arrow may be arranged in the center of the conveyor belt. Such a design of the air guiding means permits to produce an additional transverse component of the airflow. According to another alternative, it is also possible to provide the arrow-shaped arrangement of the air guiding means only in the border portion when seen in top view.

Preferably, it is provided that wing-shaped air deflectors are arranged below the conveyor belt in front of deflection areas where the conveyor belt is deflected, or at delivery points where the conveyor belt receives the textile fabric. The air deflectors prevent air swirls in the deflection areas and at the delivery points.

Moreover, air stripping means, e.g., in the form of a doctor blade, may be arranged on rotating parts to avoid drag air of the rotating part.

Such air stripping means, for example, are arranged on the deflecting rollers of the conveyor belt to avoid that the drag air entrained by the deflecting rollers generates an airflow from below toward the conveyor belt.

It is possible to adjust several air guiding means together in groups. The angle and the distance of the air guiding means to the conveyor belt and/or the mutual distance of the air guiding means in transport direction may be automatically adjustable in dependence on the transport speed and/or the mass per unit area and/or the fiber specification of the textile fabrics.

In the gaps between the air guiding means, a suction airflow can be produced by a suction means in the region of the delivery points, where the textile fabric is conveyed to the conveyor belt, for a short interval of time in order to support the starting process. Such a suction means can support the adhesion of the textile fabric during the starting operation and it is switched off when the transport speed is reached or already before, as from a transport speed of 80 m/min, for example.

Furthermore, the invention relates to a plant for manufacturing nonwoven mats, with a least one card and with at least one suctioned permeable conveyor belt for the transport of the nonwoven mat produced by the card, this plant being provided with a transport plant.

In this case, the conveyor belt can transport a mechanically produced nonwoven mat or an aerodynamically produced nonwoven mat.

The plant for manufacturing nonwoven mats can also convey several nonwoven mats on top of each other to a single conveyor belt.

In this case, the nonwoven mats can be produced by different cards or come from a double doffer card, one conveyor belt taking over one nonwoven mat, respectively. An upper nonwoven mat is then conveyed by an upper conveyor belt onto a lower nonwoven mat on a lower conveyor belt and fixed on the underlying nonwoven mat by the airflow through the conveyor belt.

The arrangement of two conveyor belts on top of each other has the additional advantage that the air flowing through the upper conveyor belt, which is led through the lower conveyor belt as well, is equalized to a high degree, whereby the danger of air whirls is strongly decreased.

The inventive method for transporting textile fabrics with a permeable and suctioned conveyor belt by delivering a textile fabric onto the moved conveyor belt provides that an increased contact pressure force against the textile fabric is generated by deflecting the drag air entrained on the lower surface of the conveyor belt.

BRIEF DESCRIPTION OF THE DRAWINGS

Hereinafter, embodiments of the invention are explained in detail with reference to the drawings, in which.

DETAILED DESCRIPTION OF THE DRAWINGS

Figure 1:
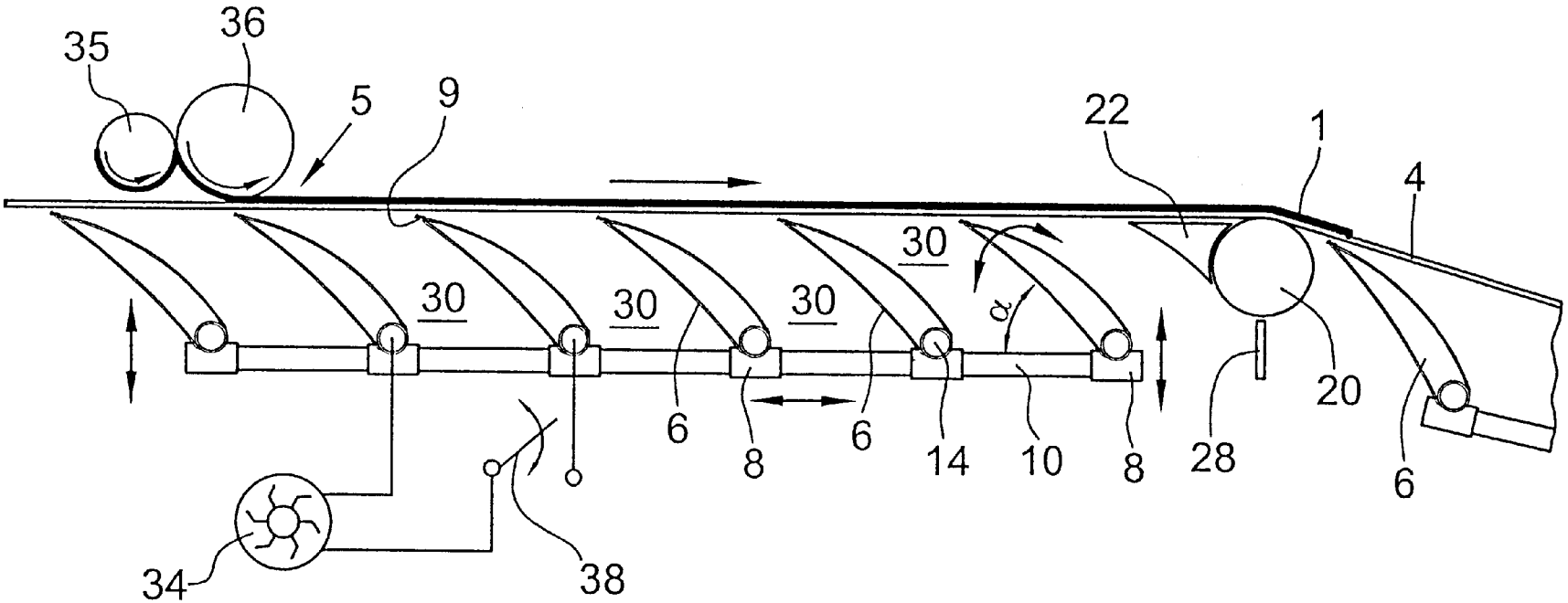
FIG. 1 shows a first embodiment of a conveyor belt with air guiding means on the lower surface thereof.

FIG. 1 shows a plant for transporting textile fabrics, with a conveyor belt 4 for the transport of a textile fabric which has been delivered from a textile machine onto the conveyor belt 4 at a delivery point 5. The textile fabric may consist of, e.g., a random web, a woven fabric, a sheet, pulp (chopped fiber material) or a nonwoven mat 1 as supplied by a card 2, or a combination or mixture of the aforementioned materials.

FIG. 1 shows doffer rollers 35,36 of a card 2 mechanically placing a textile fabric in the form of a nonwoven mat 1 onto the conveyor belt 4 at the delivery point 5. Instead of the doffer rollers 35,36, one doffer roller may also transfer a nonwoven mat 1 to the conveyor belt 4. It is also possible that the conveyor belt circulates endlessly, and it is air-permeable so that it can admit an airflow from the upper surface of the conveyor belt 4 to its lower surface. Below the conveyor belt, several air guiding means 6 are mounted, by means of mountings 8, on a supporting structure 10 extending parallel to the conveyor belt 4. By means of the mountings 8, the air guiding means 6 can be displaced along the supporting structure 10, e.g., a tube, in longitudinal direction to set a desired distance between the air guiding means 6. Preferably, the air guiding means 6 are equally spaced from each other, but it is also possible to set different distances. On the mountings 8, the air guiding means 6 are supported so as to be pivoted, and they are adapted to be fixed in different angle positions. In FIG. 1, the pivot joint 14 is arranged on the mounting 8. Relative to the plane of movement of the conveyor belt 4, it is possible to set incidence angles $\alpha$ of the air guiding means 6 of between 5 and 90°, preferably between 10 and 70°.

The angle data refer to the lower surface of the wing-like profile of the air guiding means 6 in FIG. 1 relative to the plane of transport or to the supporting structure 10 extending parallel to the plane of transport.

The air guiding means 6 may consist of straight metal sheets or also have concave or convex curvatures.

Figure 2:
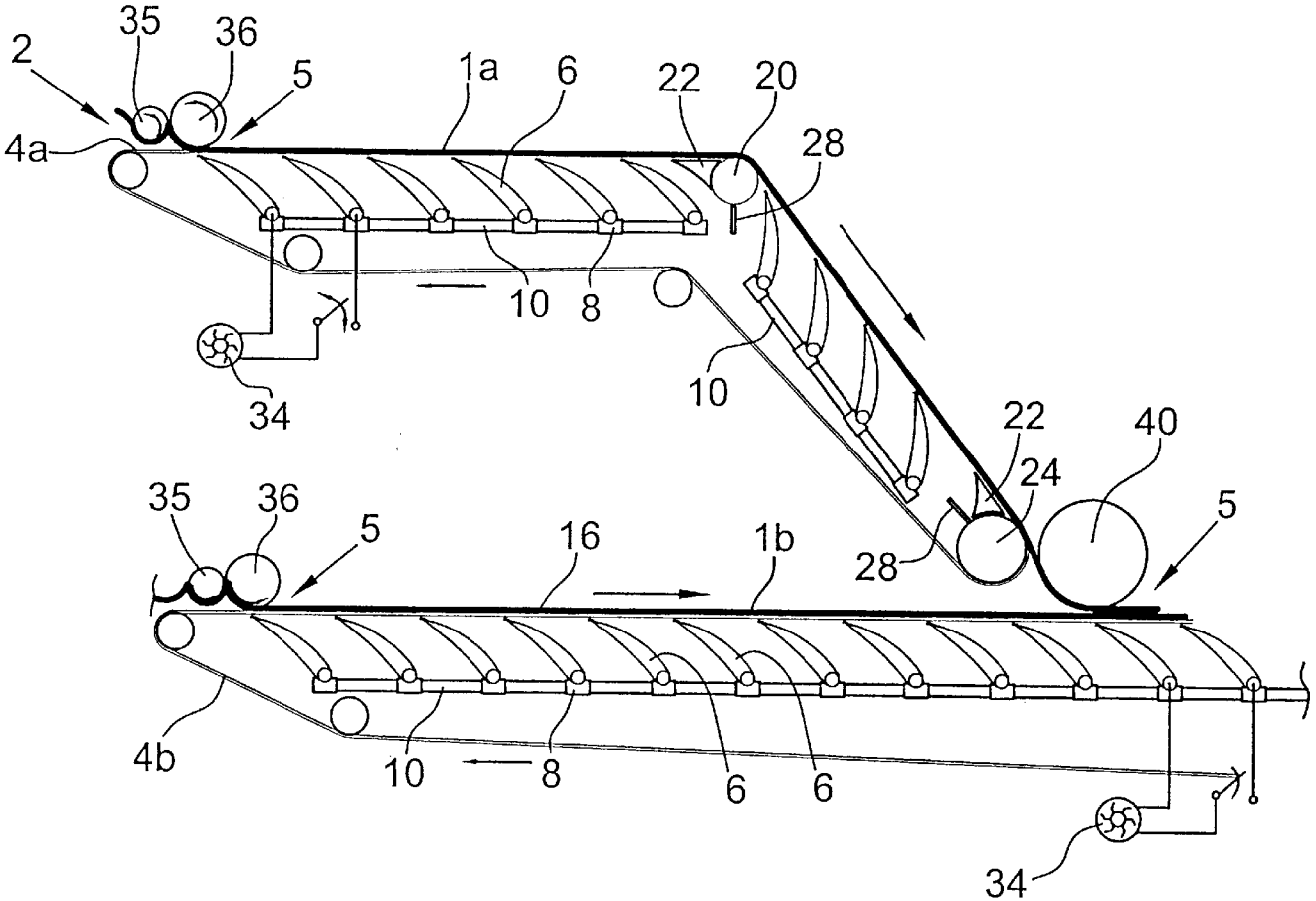
FIG. 2 shows how textile fabrics on two different conveyor belts are brought together.

The wing shape shown in FIGS. 1 and 2 leads to an increase in the air speed in the region between the air guiding means 6. The wing shape may be designed such that the curvature of the wing contour progressively increases toward the supporting structure 10.

To set the angle and the distance of the air guiding means 6 to the conveyor belt 4, the distance of the supporting structure 10 from the conveyor belt may also be variably adjustable.

The adjustable distance of the edge 9 of the air guiding means 6 facing the conveyor belt is set such that the edge 9 of the air guiding means does not touch the conveyor belt. Depending on the material of the textile fabric, a larger distance might be required.

The air guiding means 6 deflect the air entrained by the conveyor belt 4 on the lower surface thereof and thereby generate an airflow through the textile fabric and the conveyor belt 4, whereby the adhesion of the textile fabric or the nonwoven mat 1 on the conveyor belt 4 is increased to a high degree. This results in a proportionality of the contact pressure force in dependence on the transport speed. Modern high-speed textile machines permit production speeds of more than 200 m/min, and it is even striven for production speeds of more than 500 m/min. The described plant for transporting textile fabrics is suited for such high transport speeds, since the adhesion of the nonwoven mat 1 is automatically increased when the speed increases so that a disturbance of the evenness of a sensitive textile fabric by air whirls can be excluded.

Preferably, the edge 9 of one of the air guiding means 6 facing the conveyor belt 4 is located on the lower surface of the conveyor belt 4 opposite to the delivery point 5. The edge 9, for example, may extend below the axis of the doffer roller 36.

For the start operation, it is possible to additionally provide a suction means 34 for the region before or behind (FIG. 1) the delivery point 5, which is switched on during the start operation for a short time and can be switched off again, e.g., via a flap 38 and by stopping a fan, when a higher conveyor belt speed is reached. The suction means 34, for example, can be switched off when a conveyor belt speed of at least 80 m/min has been reached.

The supporting structure 10 may be provided with means not illustrated in the drawings by means of which the air guiding means 6 are adjustable, in groups, with respect to angle and distance to the conveyor belt and/or with respect to the position of the air guiding means 6 relative to the delivery point 5.

Moreover, angle and distance to the conveyor belt can be automatically adjusted, considering the transport speed and/or the mass per unit area of the textile fabric 1 and/or the fiber specification of the textile fabric 1.

On the rotating parts, e.g., of the roller 20, as far as to the wedge between the moving conveyor belt and the roller 20, an air deflector 22 is arranged, deflecting the air entrained by the conveyor belt 4 in front of the deflecting roller 20. Additionally, an air stripping means 28 in the form of a doctor blade may be provided on the deflecting roller 20, stripping the air entrained by the deflecting roller 20.

FIG. 2 shows a plant for transporting textile fabrics 1 where two nonwoven mats 1*a*,1*b* are brought together onto a lower conveyor belt 4. The nonwoven mats 1*a*,1*b* may be supplied by different carding machines or come from a double doffer card.

The upper conveyor belt 4*a* as well as the lower conveyor belt 4*b* are endlessly circulating and provided with the air guiding means 6 already described in connection with FIG. 1. At the delivery point 7 where the nonwoven mats 1*a*,1*b* are brought together, a roller 40 is arranged which may consist, for example, of a smooth roller, a circular roller or a perforated cylinder and which delivers the nonwoven mat 1*a* to the lower conveyor belt 4*b*.

The air guiding means generate a high air volume flow through the nonwoven mat and the conveyor belt 4.

With the arrangement according to FIG. 2, the air sucked through the conveyor belt 4*a* is equalized to a high degree so that a sufficiently large volume flow equally distributed over the entire working width can be supplied to the lower conveyor belt 4*b*.

Figure 3:
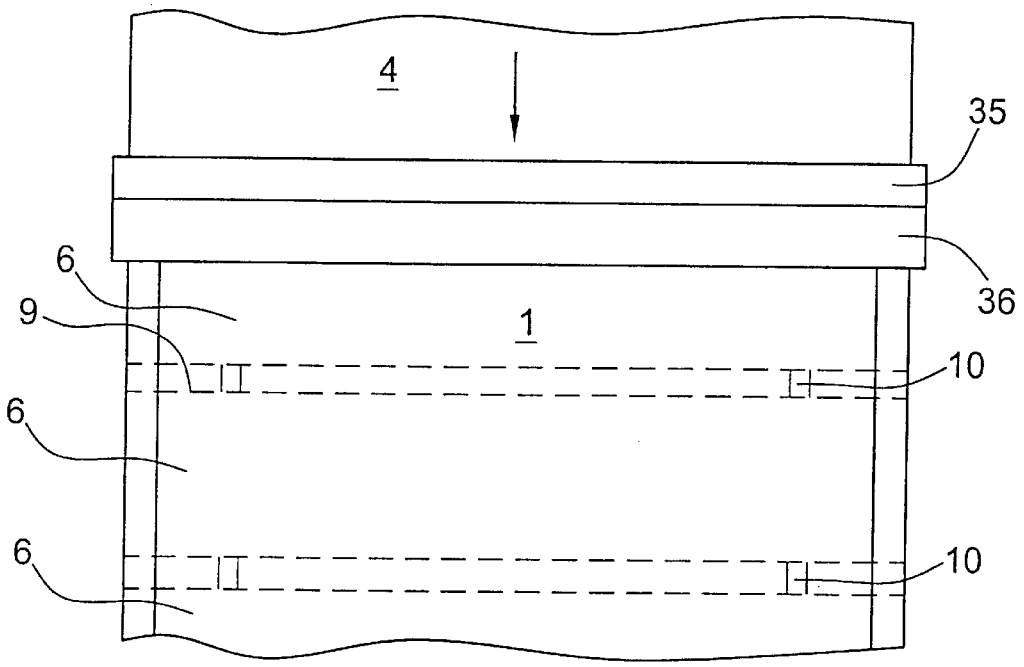
FIG. 3 shows a top view of the embodiment of FIG. 1, and FIGS. 4 to 8 show further embodiments of air guiding means.

FIG. 3 shows a top view of the embodiment according to FIG. 1.

Figure 4:
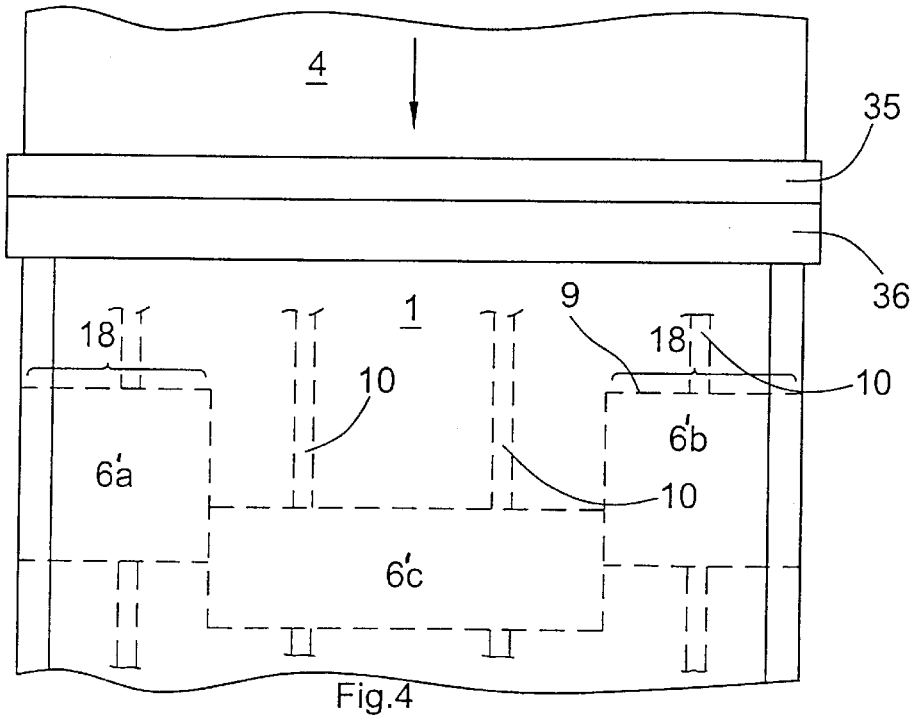

FIG. 4 shows another embodiment of the air guiding means wherein the air guiding means consist of three parts; sections 6'*a*, 6'*b* being arranged in border portions 18 of the conveyor belt 4 and a central section 6'*c* being offset to the rear with respect to the sections 6'*a*, 6'*b* arranged in the border portion. The central air guiding means 6'*c* may also have a different incidence angle and a different distance with respect to the conveyor belt 4.

Figure 5:
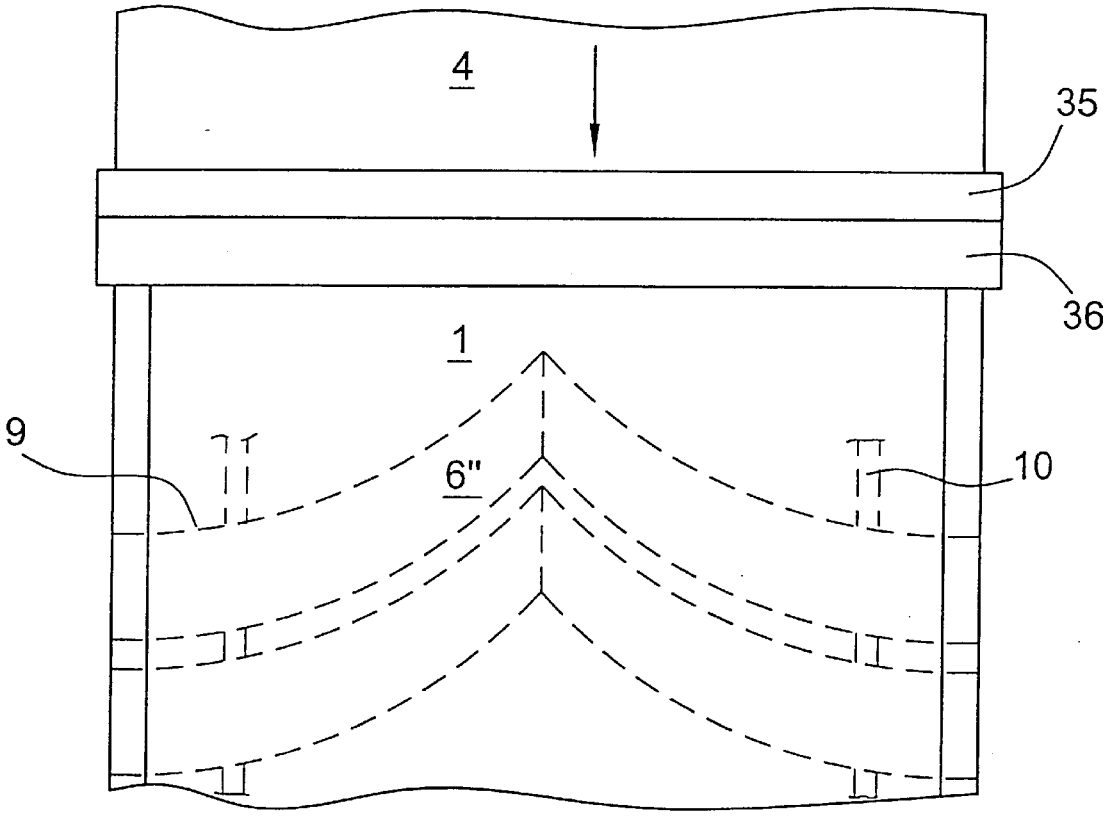

FIG. 5 shows a further embodiment of the air guiding means 6" extending over the entire working width of the conveyor belt 4. The arrow-shaped air guiding means 6', 6", 6'" illustrated in FIGS. 4 to 6 permit an additional transverse component of the air flow, which is either effective in a border portion only (FIGS. 4 and 6) or even over the entire working width.

Figure 6:
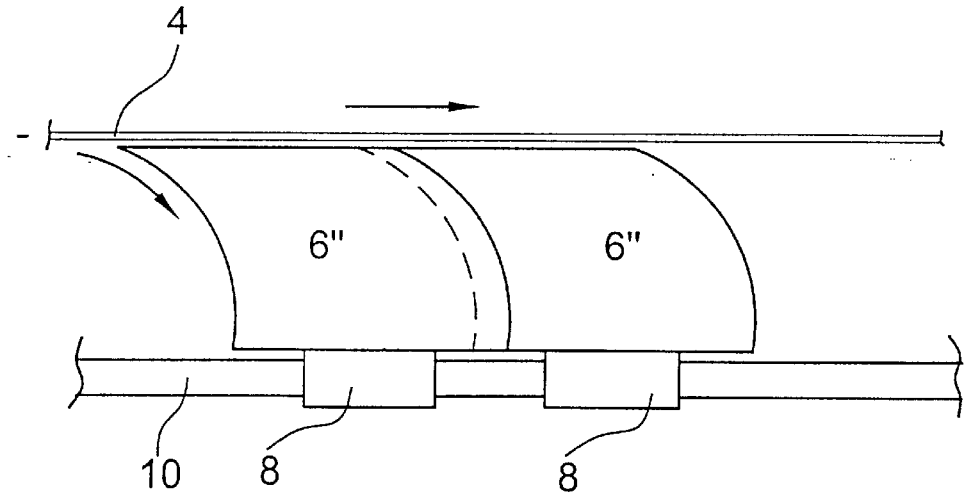

FIG. 6 shows a side view of the embodiment of FIG. 5. Here, the air guiding means are arranged behind each other similar to plough blades.

In the embodiment of FIGS. 5 and 6, it is not possible to set an incidence angle of the air guiding means 6" to the conveyor belt 4, but only the distance to the conveyor belt is adjustable.

Figure 7:
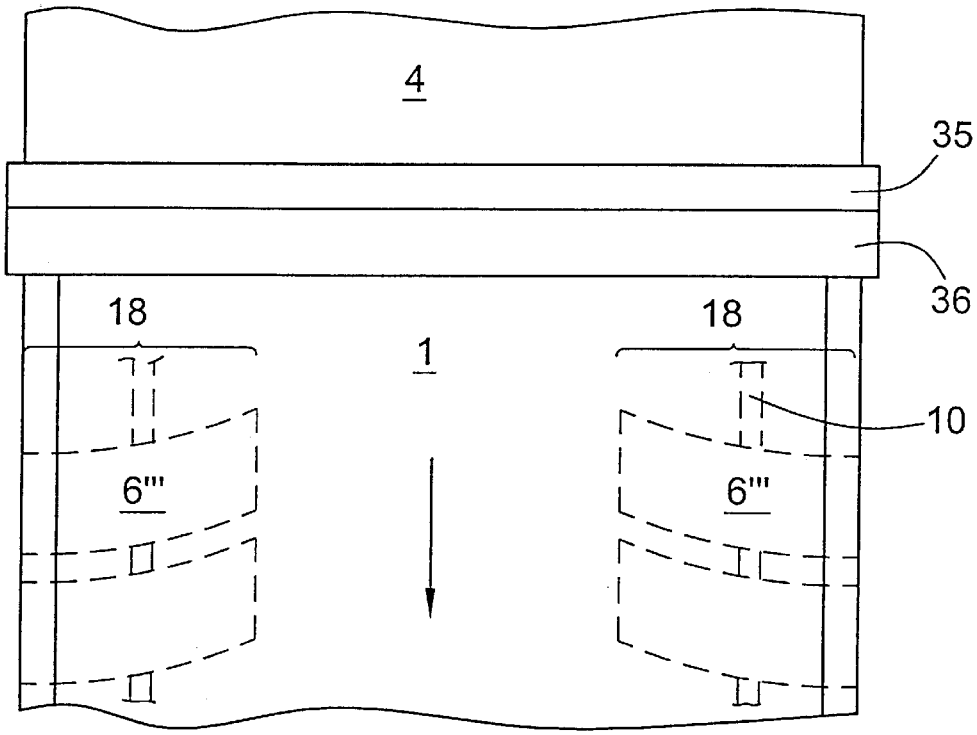

FIG. 7 shows a further embodiment of the air guiding means 6'" provided only in a border portion 18 of the conveyor belt 4.

Figure 8:
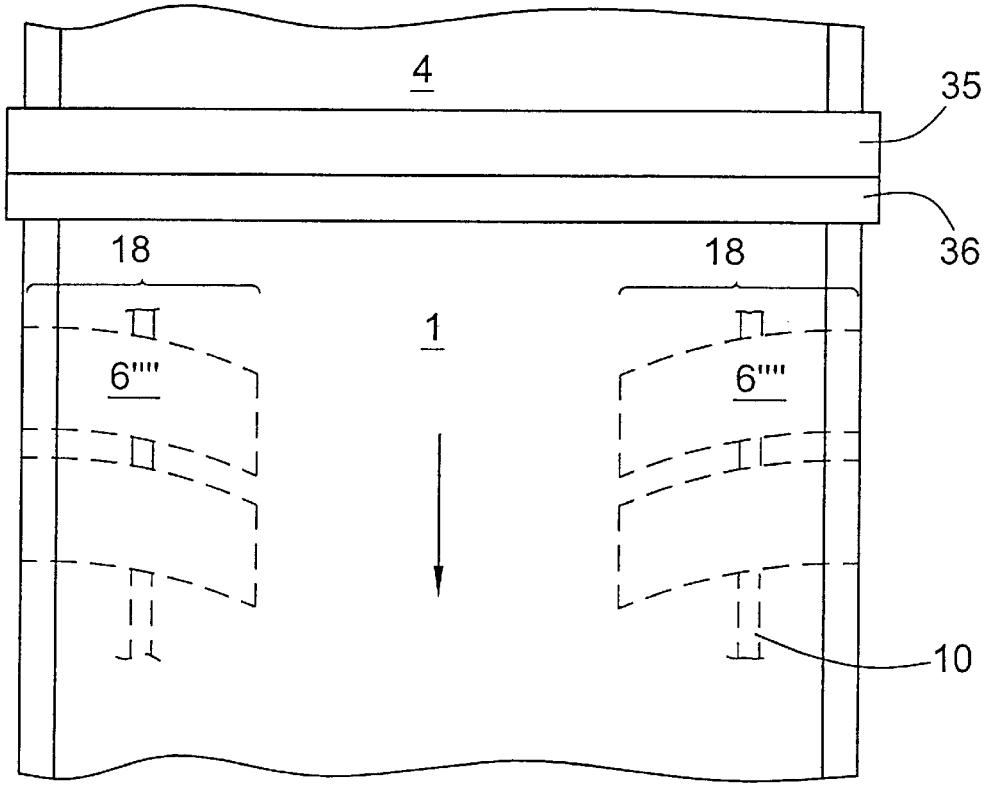

FIG. 8 shows an embodiment according to FIG. 7 wherein the air guiding means 6' have an opposed curvature in comparison with FIG. 7.

Although a preferred embodiment of the invention has been specifically illustrated and described herein, it is to be understood that minor variations may be made in the apparatus without departing from the spirit and scope of the invention, as defined by the appended claims.

What is claimed is:

1. A plant for transporting a textile fabric comprising at least one air-permeable conveyor belt (4) having a conveyor belt run moving in a predetermined direction of travel for transporting a textile fabric (1, 1*a* and/or 1*b*), said conveyor belt run having one side immediately adjacent the textile fabric and a second opposite side remote from the textile fabric, air guide means (6, 6'*a*, etc.) located transversely to and contiguous said conveyor belt second opposite side, and said air guiding means (6, 6'*a*, etc.) being constructed and arranged for increasing positive air flow in the direction of conveyor belt upper run travel to thereby decrease pressure along the conveyor belt second opposite side as compared to the air flow and pressure, respectively, at the conveyor belt one side absent air evacuation.

2. The plant as defined in claim 1 wherein an edge (9) of the air guiding means (6, 6'*a*, etc.) is located in substantially close spaced relationship to the conveyor belt run second opposite side.

3. The plant as defined in claim 1 wherein an edge (9) of the air guiding means (6, 6'*a*, etc.) is located in substantially close spaced relationship to the conveyor belt run second opposite side, and means for adjusting the distance between the air guide means edge (9) and the conveyor belt run second opposite side.

4. The plant as defined in claim 1 including a supporting structure (10) for supporting the conveyor belt (4) substantially along the length thereof, and means for mounting said air guiding means (6) relative to said supporting structure (10).

5. The plant as defined in claim 1 including means for mounting the air guiding means (6) for pivoting movement about an axis (14) disposed substantially transversely to the conveyor belt upper run path of travel.

6. The plant as defined in claim 1 wherein said conveyor belt upper run includes a delivery point (5) at which the textile fabric is delivered thereto, and at least one of said air guiding means (6) is located substantially at and below said deliver point (5).

7. The plant as defined in claim 1 wherein said air guiding means are inclined toward said conveyor belt second opposite side and in opposition to said conveyor run direction of travel and defined therewith an acute angle.

8. The plant as defined in claim 1 wherein said air guiding means are inclined toward said conveyor belt second opposite side and in opposition to said conveyor run direction of travel and defined therewith an acute angle, and said air guiding means includes an upper convex surface.

9. The plant as defined in claim 1 wherein the air guiding means are arranged at least one of (a) across the entire width of the conveyor belt upper run, (b) only along a border portion of the conveyor belt upper run, and (c) in alternating relationship in the conveyor belt upper run direction of travel.

10. The plant as defined in claim 1 wherein the air guiding means define an angle ranging between 5° to 90° relative to the conveyor belt run second opposite side.

11. The plant as defined in claim 1 wherein the air guiding means is of an aerodynamic wing profile in cross section.

12. The plant as defined in claim 1 wherein the air guiding means extend substantially across the entire width of the conveyor belt upper run.

13. The plant as defined in claim 1 wherein the air guiding means extend at least along a border portion of the conveyor belt upper run.

14. The plant as defined in claim 1 wherein the air guiding means extend at least along a border portion of the conveyor belt upper run and obliquely to the conveyor upper run path of travel.

15. The plant as defined in claim 1 including an aero-shape air deflector (22) located adjacent the conveyor belt run second opposite side at a deliver point of the conveyor belt.

16. The plant as defined in claim 1 including rotating supports for supporting said conveyor belt, and air stripping means adjacent said rotating supports for reducing air drag.

17. The plant as defined in claim 1 wherein said air guiding means are arranged in a plurality in at least two groups, and means for adjusting each group.

18. The plant as defined in claim 1 wherein said air guiding means are arranged in a plurality in at least two groups, and means for adjusting each group individually.

19. The plant as defined in claim 1 including means for automatically adjusting the distance between the air guiding means and the conveyor belt run second opposite side in dependence upon at least one of (a) the speed of the conveyor belt upper run, (b) the mass per unit area of the textile fabric and (c) the fiber specification of the textile fabric.

20. The plant as defined in claim 1 wherein said conveyor belt upper run includes a delivery point at which the textile fabric is delivered to the conveyor belt upper run, evacuation means at said delivery point, and means for effecting suction air flow by said suction means for a short interval of time at the initiation of textile fabric delivery to the delivery point.

21. The plant as defined in claim 1 including at least one card means (2) upstream of a deliver point of said permeable conveyor belt (4) for producing said textile fabric (1) in the form of a non-woven mat.

22. The plant as defined in claim 21 wherein said at least one card means (2) includes a roller (36) for delivering the non-woven mat (1) to the delivery point.

23. The plant as defined in claim 21 wherein the non-woven mat (1) is formed aerodynamically on the conveyor belt one side.

24. The plant as defined in claim 2 wherein said conveyor belt upper run includes a delivery point (5) at which the textile fabric is delivered thereto, and at least one of said air guiding means (6) is located substantially at and below said deliver point (5).

25. The plant as defined in claim 2 wherein said air guiding means are inclined toward said conveyor belt second opposite side and in opposition to said conveyor run direction of travel and defined therewith an acute angle.

26. The plant as defined in claim 2 wherein said air guiding means are inclined toward said conveyor belt second opposite side and in opposition to said conveyor run direction of travel and defined therewith an acute angle, and said air guiding means includes an upper convex surface.

27. The plant as defined in claim 3 wherein said conveyor belt upper run includes a delivery point (5) at which the textile fabric is delivered thereto, and at least one of said air guiding means (6) is located substantially at and below said deliver point (5).

28. The plant as defined in claim 3 wherein said air guiding means are inclined toward said conveyor belt second opposite side and in opposition to said conveyor run direction of travel and defined therewith an acute angle.

29. The plant as defined in claim 3 wherein said air guiding means are inclined toward said conveyor belt second opposite side and in opposition to said conveyor run direction of travel and defined therewith an acute angle, and said air guiding means includes an upper convex surface.

* * * * *